US005101708A

United States Patent [19]

Sommer et al.

[11] Patent Number: 5,101,708

[45] Date of Patent: Apr. 7, 1992

[54] UNBALANCE-COMPENSATING DEVICE FOR A WEAPONS SYSTEM

[75] Inventors: Heinrich Sommer, Grebenstein; Peter Muhlhausen, Ahnatal; Horst Wollmert, Staufenberg, all of Fed. Rep. of Germany

[73] Assignee: Wegman & Co. GmbH, Kassel, Fed. Rep. of Germany

[21] Appl. No.: 576,625

[22] Filed: Aug. 31, 1990

[30] Foreign Application Priority Data

Sep. 6, 1989 [DE] Fed. Rep. of Germany ..... 3929550

[51] Int. Cl.[5] ..... F41A 27/30

[52] U.S. Cl. ..... 89/37.08

[58] Field of Search ..... 89/37.07, 37.08, 40.01

[56] References Cited

U.S. PATENT DOCUMENTS

| | | | |
|---|---|---|---|
| 877,521 | 1/1908 | Schneider et al. | 89/37.08 |
| 1,079,816 | 11/1913 | Weinholtz | 89/40.01 |
| 1,374,862 | 4/1921 | Peoples | 89/37.08 |
| 1,722,397 | 7/1929 | Schuler et al. | 89/40.01 |
| 2,564,360 | 8/1951 | Hammar et al. | 89/37.08 |
| 2,600,462 | 6/1952 | Bateman | 89/40.01 |

FOREIGN PATENT DOCUMENTS

| | | | |
|---|---|---|---|
| 1027729 | 4/1966 | United Kingdom | 89/37.08 |

*Primary Examiner*—Stephen Johnson

*Attorney, Agent, or Firm*—Sprung Horn Kramer & Woods

[57] ABSTRACT

A weapons system has a stationary base and an assembly that has the tube mounted on it, that pivots in the direction of elevation, and that is mounted on a trunnion in a stationary base. The center of gravity of the pivoting assembly is outside the axis of rotation of the trunnion. A torque that opposes the moment of unbalance is generated by at least one suspension mechanism consisting of at least one torsion-bar suspension mechanism, one end of which is non-rotationally secured to the base and the other end of which is secured to the weapon's pivoting assembly by way of a transmission mechanism. The transmission mechanism contains at least one additional suspension element.

4 Claims, 3 Drawing Sheets

UNBALANCE-COMPENSATING DEVICE FOR A WEAPONS SYSTEM

BACKGROUND OF THE INVENTION

The invention concerns an unbalance-compensating device for a weapons system, especially a heavy weapon, with an assembly that has the tube mounted on it, that pivots in the direction of elevation, and that is mounted on a trunnion in a stationary base, whereby the center of gravity of the pivoting assembly is outside the axis of rotation of the trunnion and wherein a torque that opposes the moment of unbalance is generated by at least one suspension mechanism.

An unbalance-compensating device of this type is the object of a pending U.S. patent application 402,275. The device disclosed in that application is intended to be very simple, weigh little, occupy very little space, and provide satisfactory compensation of the unbalance moment even at wide aiming angles.

That object was attained by the improvement wherein the suspension system consisted of at least one torsion-bar suspension mechanism, one end of which is non-rotationally secured to the base and the other end of which is secured to the weapon's pivoting assembly by way of a transmission mechanism.

SUMMARY OF THE INVENTION

The object of the present invention is an improvement and development of the prior unbalance-compensating device.

The following considerations represent the point of departure for the current invention.

In an unbalance-compensating device in accordance with the parent patent, the torsion-bar energy $E_{FD}$ available for compensation and forwarded to the weapon by way of transmission is defined as a straight line by the equation $$E_{FD}=\tfrac{1}{2}c_D(\alpha_{1G}^2-\alpha_{1V}^2)$$

where $c_D$ represents the bar's resistance to torsion, $\alpha_{1G}$ is its angle of rotation with the pivoting assembly of the weapon at minimum elevation, and $\alpha_{1V}$ is its angle of rotation with the pivoting assembly at maximum elevation.

The energy $E_u$ necessary for completely compensating a weapon's unbalance is the mechanical work that must be supplied to the weapon in pivoting it from its lowest to its highest elevation:

$$dE_u = M_{u2}\cdot d\alpha_2$$

$$M_{u2} = M_{u20}\cdot\cos\alpha_2$$

$$E_u = M_{u20}\cdot\int_{\alpha_{2min}}^{\alpha_{2max}}\cos\alpha_2\cdot d\alpha_2$$

where $M_{u20}$ is the maximum unbalance moment with the weapon elevated to $\alpha_2=0°$, $\alpha_{2max}$ is the maximum elevation of the pivoting assembly of the weapon, and $\alpha_{2min}$ is the minimum elevation of the pivoting assembly.

The energy $E_{FD}$ stored in a particular torsion bar employed to save space or for other purposes may turn out to be essentially lower than the energy $E_u$ needed to completely compensate for unbalance.

The object of the present invention is, with the object of the prior document as a point of departure, to provide a simple means of storing more energy and of arriving at almost perfect unbalance compensation.

This object is attained in accordance with the present invention in that the aforesaid transmission mechanism contains at least one additional spring element.

The transmission mechanism in one advantageous embodiment of the invention has a lever that is non-rotationally secured to the aforesaid second end of the torsion-bar suspension mechanism and articulated to a telescopic leg that is itself articulated to the pivoting assembly of the weapon by at least one compression spring. The compression spring can be tensioned against a stop and its extension limited by another stop.

Many of the features of the prior invention can be combined to advantage with those of the present invention. It is for example of particular advantage for the torsion bar to be concentrically accommodated at least along some of its length in a protective cylinder that rotates on the base with one end secured non-rotatably to the other end of the bar and with the transmission that forwards the rotary motion secured to the cylinder. The cylinder itself can constitute a torsion bar.

The principle behind the invention consists of positioning additional mechanisms in the form of spring mechanisms between the torsion bar and the weapon in the transmission mechanism in order to store the absent energy needed for complete unbalance compensation. Especially appropriate in a four-member transmission for example is to connect the lever secured to the second end of the torsion bar to the weapon's pivoting assembly with another energy reservoir in the form of a telescopic leg. The compression spring, which can have a linear characteristic for example, must be designed taking into account the variable transmission ratio in relation to the unbalance moment to approximate the equations $$E_u=E_{FD}+E_{FL} \text{ and}$$

$$E_{FL}=E_u-E_{FD}=\tfrac{1}{2}C_L(I_G^2-I_V^2)$$

where $E_{FL}$ is the energy accommodated by the link in the form of a compression spring with the weapon at its lowest elevation, $C_L$ is the compression spring's antiresilience, $I_G$ is the deflection of the spring at $\alpha_{2min}$, and $I_V$ is the spring's deflection at $\alpha_{2max}$.

BRIEF DESCRIPTION OF THE DRAWINGS

One embodiment of an unbalance-compensating device in accordance with the invention will now be described in greater detail with reference to the drawings, wherein.

DETAILED DESCRIPTION OF THE INVENTION

Figure 1:
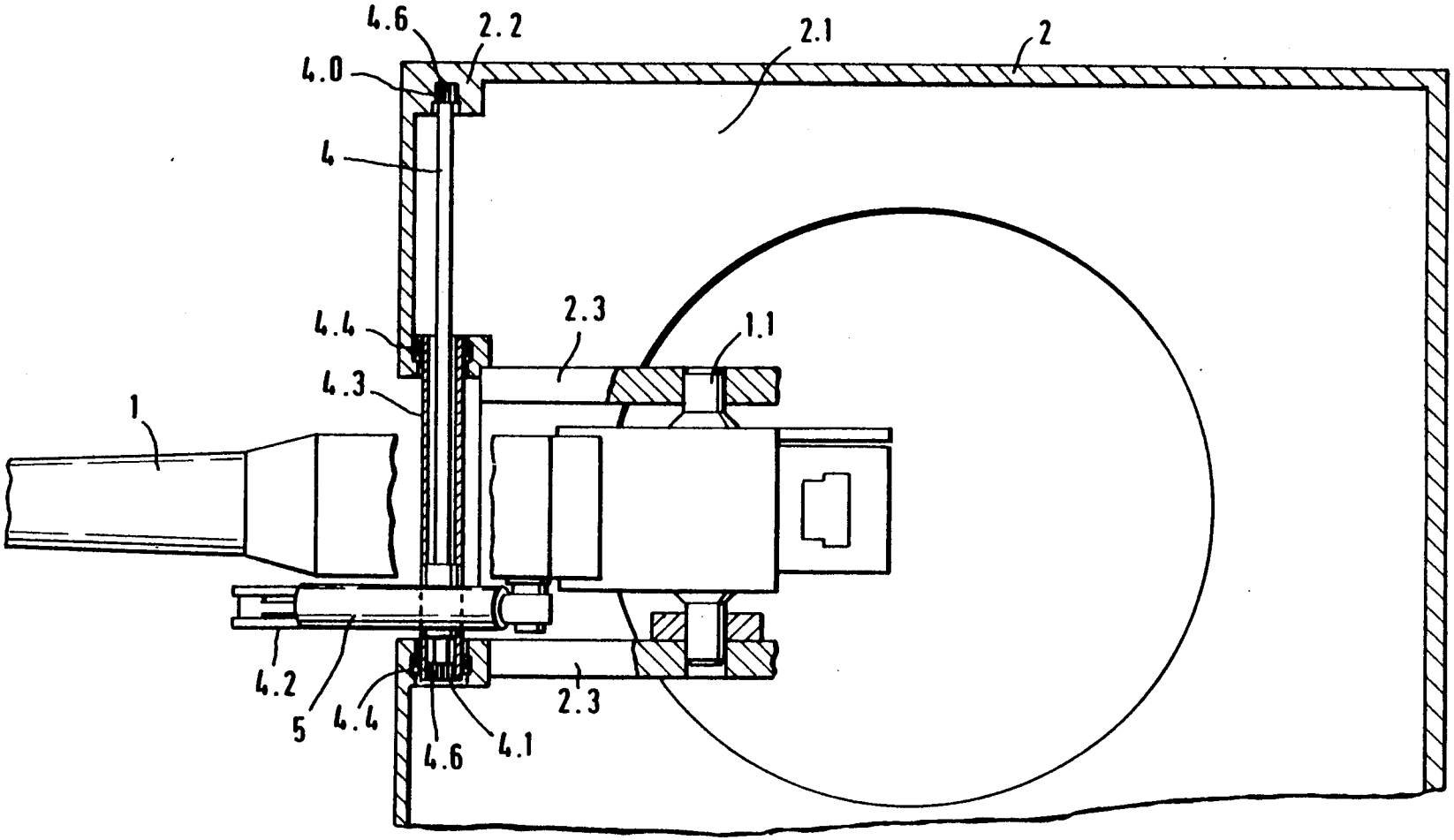
FIG. 1 is a schematic and partly sectional top view of part of a weapons system with an unbalance-compensating device at the turret of a military tank.
Figure 2:
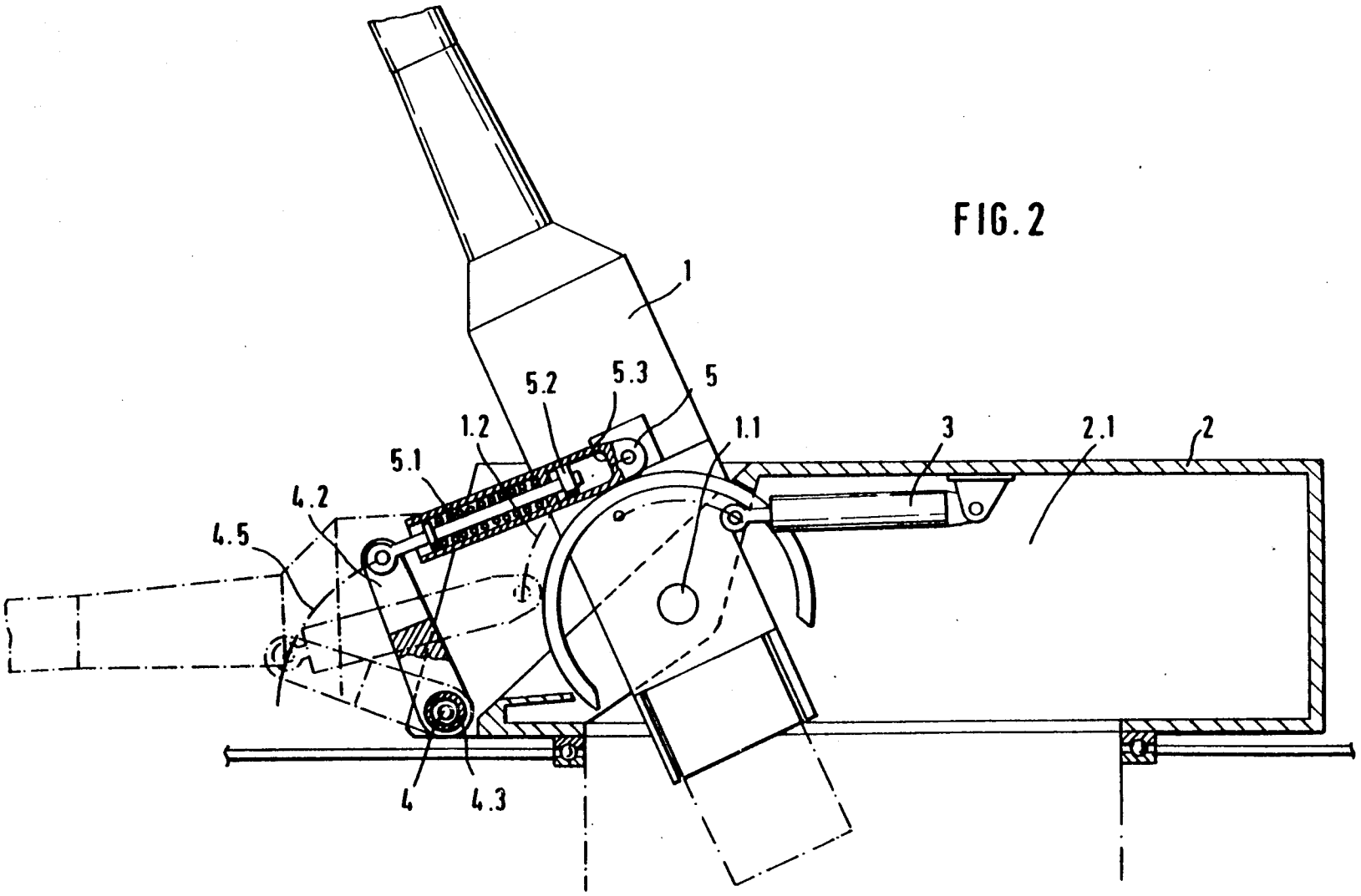
FIG. 2 is a partly sectional side view of the weapons system and unbalance-compensating device illustrated in FIG. 1.

FIGS. 1 and 2 are highly schematic representations of a weapons system in the turret of a military tank with a stationary base or gu carriage in the form of a turret 2 and a pivoting assembly 1 in the form of a tube and cradle. Assembly 1 can be pivoted in the elevation direction on a trunnion 1.1 in stationary base 2 by an aiming mechanism 3.

Accommodated in the interior 2.1 of turret 2, parallel to the axis of rotation of trunnion 1.1 and accordingly upstream of the trunnion in the direction of fire, and below pivoting assembly 1 is a torsion-bar suspension mechanism 4, one end 4.0 of which is secured by way of a series of notches 4.6 in a pillow block 2.2 that is secured to turret 2. The other and free end 4.1 of torsion-bar suspension mechanism 4 is non-rotationally secured by another series of notches 4.6 to a protective cylinder 4.3. The cylinder concentrically surrounds torsion-bar suspension mechanism 4 to about half its length and rotates on balls or roller bearings 4.4 in the walls 2.3 of the weapon well. Secured to the outside circumference of protective cylinder 4.3 is a lever 4.2 that is articulated to one end of a telescopic leg 5. The other end of the leg is articulated to the weapon's pivoting assembly 1. Inside telescopic leg 5 is a compression spring 5.1 that can be tensioned with a threaded stop 5.2. The extension of compression spring 5.1 is also limited by a stationary stop 5.3.

The torque of torsion-bar suspension mechanism 4 is initially transmitted to protective cylinder 4.3, which also, due to its resiliency, acts as a torsion-bar suspension mechanism, and hence by way of lever 4.2 and telescopic leg 5 to pivoting assembly 1. A crank throw 1.2 is dictated by the point of articulation to pivoting assembly 1, and lever 4.2 has another crank throw 4.5. The particular crank throws 1.2 and 4.5 employed dictate the tension, the torsion angle, and the moment of torsion-bar suspension mechanism 4 that is to be transmitted. Telescopic leg 5, which acts as another energy reservoir, is designed in accordance with the foregoing formulas.

Pivoting assembly 1 and the lever transmission mechanism are illustrated in two different positions in FIG. 2, one with continuous lines and the other with dot-and-dash lines. In the position depicted by the continuous lines, which represent a high elevation of weapon 1, telescopic leg 5 is obviously slightly longer than it is in the position depicted by the dot-and-dash lines, which represent weapon 1 at a lower elevation. This variation in length allows the desired adjustment to the transmission ratio.

Figure 3:
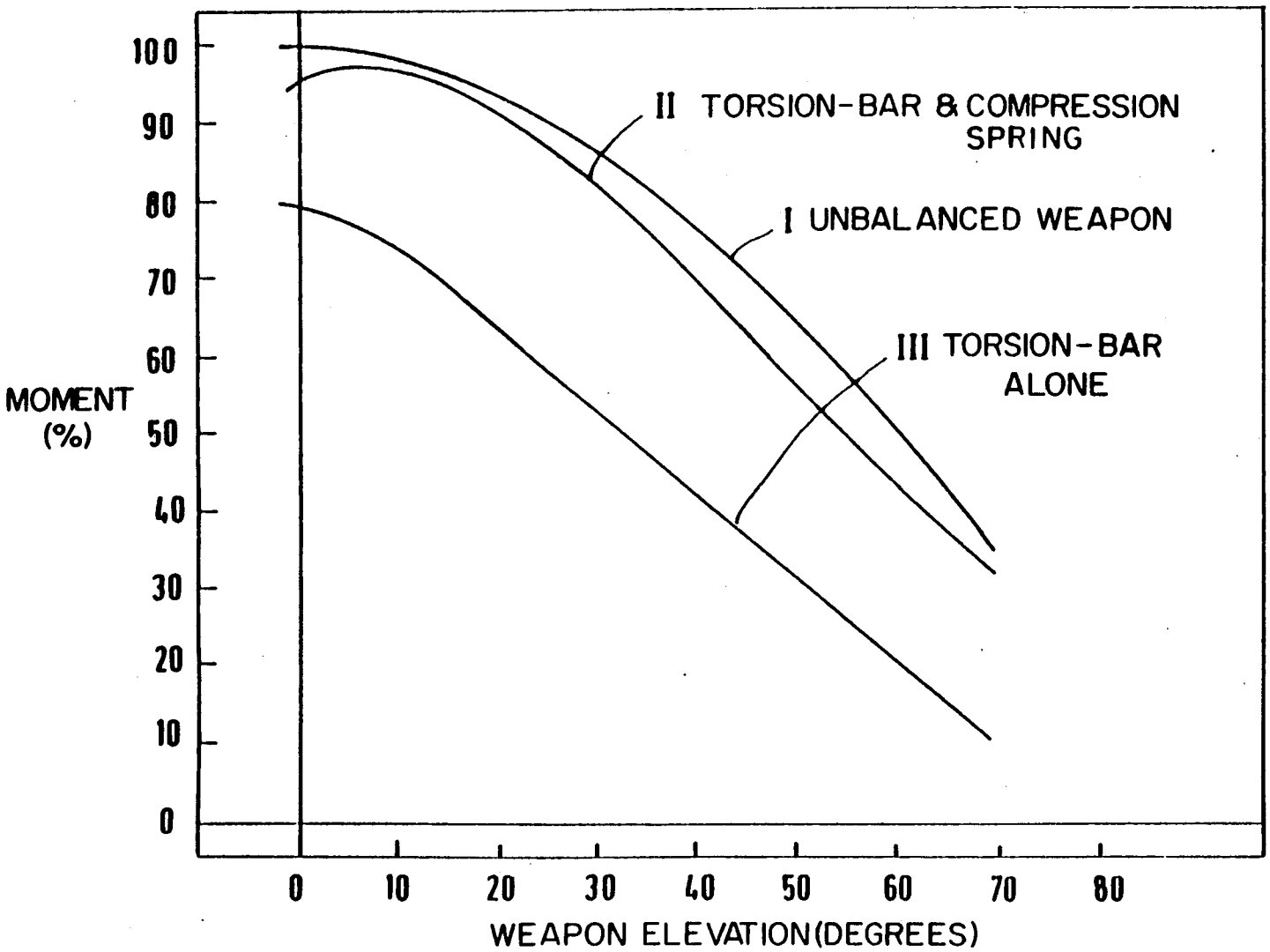
FIG. 3 is a graph of the weapons system's unbalance curve and of the unbalance-compensating device's characteristic.

The curves I, II, and III in FIG. 3 represent the advantageous effects of the additional energy reservoir in the form of a compression spring with reference to the example of a four-link transmission mechanism.

Curve I illustrates the weapons moment of unbalance as a function of weapon elevation $\alpha_2$ in the form of a cosine.

Curve III represents the moment of compensation that can be attained with a torsion-bar suspension mechanism alone, whereby only an incomplete unbalance compensation is, as will be evident from a comparison with Curve I, attained.

Curve II shows the moment of compensation attainable by using a torsion-bar suspension mechanism in conjunction with an additional energy reservoir in the form of a compression spring designed in accordance with the aforesaid equations.

As will be evident from a comparison with Curve I, the additional compression spring ensures as desired an almost perfect unbalance compensation, and the remaining slight discrepancy can be desirable in terms of suppressing play.

To make it possible to store the energy needed for almost perfect unbalance compensation adjusted to the cosine of weapon unbalance and to recover it again, the compression spring can be either untensioned or tensioned by threaded stop 5.2. The extension of the spring can also be limited by stationary stop 5.3.

What is claimed is:

1. A weapons system comprising: a stationary base; a weapon assembly having a tube; a trunnion for mounting the assembly on the stationary base for movement around an axis of rotation; means mounting the tube for pivotal movement in a direction of elevation with a center of gravity outside the axis of rotation; a suspension mechanism for producing a torque opposing a moment of imbalance and comprising a torsion-bar suspension mechanism having one end fixed to the base and another end of the torsion-bar suspension mechanism connected through a transmission mechanism to the assembly, wherein the transmission mechanism comprises a lever that is non-rotationally secured to the another end of the torsion-bar suspension mechanism and articulated to a telescopic leg and a compression spring articulating the telescopic leg to the assembly.

2. The system as in claim 1, wherein the compression spring is tensioned by a stop.

3. The system as in claim 2, wherein the compression spring has an excursion limited by another stop.

4. The system as in claim 1, wherein the suspension mechanism further comprises a second torsion-bar suspension mechanism having ends mounted for rotation relative to the base.

* * * * *